US006520403B1

(12) United States Patent
Lapoint, III

(10) Patent No.: US 6,520,403 B1
(45) Date of Patent: Feb. 18, 2003

(54) STORAGE CONTAINER

(75) Inventor: John H. Lapoint, III, Lewiston, ME (US)

(73) Assignee: Lapoint Industries, Inc., Lewiston, MA (US)

( * ) Notice: Subject to any disclaimer, the term of this patent is extended or adjusted under 35 U.S.C. 154(b) by 0 days.

(21) Appl. No.: 09/710,592

(22) Filed: Nov. 9, 2000

(51) Int. Cl.[7] ..... B65D 5/60; B65D 25/14

(52) U.S. Cl. ..... 229/117.35; 383/109; 383/113; 383/119

(58) Field of Search ..... 229/117, 35; 383/24, 383/99, 104, 109, 111, 113, 119, 906

(56) References Cited

U.S. PATENT DOCUMENTS

| | | | | | |
|---|---|---|---|---|---|
| 1,768,989 | A | * | 7/1930 | Laacke | 383/99 |
| 4,781,472 | A | * | 11/1988 | LaFleur et al. | 383/111 |
| 4,851,290 | A | * | 7/1989 | Vick | 428/349 |
| 4,994,324 | A | * | 2/1991 | Bose et al. | 428/349 |
| 5,323,922 | A | | 6/1994 | Lapoint, et al. | |
| 5,423,611 | A | * | 6/1995 | Sherrard | 383/119 |
| 6,000,604 | A | | 12/1999 | Lapoint, III | |
| 6,068,032 | A | * | 5/2000 | Milner | 206/223 |
| 6,294,761 | B1 | * | 9/2001 | Diederich et al. | 383/906 |
| 6,302,584 | B1 | * | 10/2001 | Derby et al. | 383/113 |

OTHER PUBLICATIONS

The Wiley Encyclopedia of Packaging Technology, John Wiley & Sons, 1986, pp. 477, 478,536,537.*

* cited by examiner

*Primary Examiner*—Gary E. Elkins
(74) *Attorney, Agent, or Firm*—Pierce Atwood

(57) ABSTRACT

A container for retaining bulk materials for storage and/or transport. The container includes improvements over existing collapsible containers designed for the same purpose. The container of the present invention includes an impervious liner for receiving and retaining within the container bulk materials for which contact with reactive fluids is undesirable. Such bulk materials include, but are not limited to, spent catalysts. The impervious liner is preferably made of a material such as a polypropylene/nylon/polypropylene blend. An additional feature of the present invention is a weather-blocking cover that is adapted to be connected to the walls of a bulk container that may or may not be collapsible. The weather-blocking cover is adapted to seal off upper surfaces and edges of the container so that the container may be stored externally for extended periods without fear that precipitation will seep into the interior of the container.

16 Claims, 5 Drawing Sheets

STORAGE CONTAINER

BACKGROUND OF THE INVENTION

1. Field of the Invention

The present invention relates to containers for storing and/or transporting materials. More particularly, the present invention relates to collapsible containers that may be employed to transport bulk materials including, but not limited to, hazardous materials. Still more particularly, the present invention relates to collapsible storage containers and protective covers therefor.

2. Description of the Prior Art

Metal containers are generally used to store and transport bulk materials, particularly hazardous materials. These metal containers are expensive to purchase or, more often, to rent. They are fairly large and therefore require a considerable amount of space to maintain on site. That required space could be considerable, dependent upon the amount of material that must be stored and/or transported. Alternatively, bag containers have been employed. Such bags take up much less space when not in use. However, such bags are of insufficient physical characteristics for transport purposes. That is, they are generally not tough enough to stand up to the rigors of movement by mechanical devices such as forklifts, accidental drops into cargo holds, stacking, and the like.

In order to overcome the limitations associated with flexible bags and rigid metal boxes, a collapsible container has been developed. The best of the collapsible containers suitable for the storage and/or transport of bulk materials including hazardous materials is one offered by U.F. Strainrite, Inc. of Lewiston, Me., the assignee of the present invention. The Strainrite collapsible storage container is described in U.S. Pat. No. 6,000,604, issued Dec. 14, 1999, and in U.S. Pat. No. 5,323,922, issued Jun. 28, 1994. The contents of both of those patents are incorporated herein by reference.

The collapsible container offered by Strainrite is based upon a multi-walled box of the type shown in FIG. 1. In the commercial configuration shown in that drawing, the container 10 includes a base 20 and coupled to walls 12, 14, 16, and 18. Each wall is formed of a sandwich of tough woven flexible material encasing a rigid member, such as a corrugated board. The two outer woven materials are coupled together to retain the rigid member therebetween. Opposing walls 12 and 18 each includes an integral flap 26 made of the flexible material and preferably omitting the rigid member. Wall 14 includes a short integral flap 24 and wall 16 includes integral covering flap 22. As indicated in U.S. Pat. No. 6,000,604, flap 22 is designed to act as a single complete covering that ensures material within the container 10 will not escape under expected transport conditions. A supplemental retaining bag 32 may also form part of the container 10, particularly when the material 50 to be retained therein is relatively fluid.

The walls 12, 14, 16, and 18 of the prior container 10 are coupled together and arranged so that they may be collapsed adjacent to one another while remaining coupled together in a substantially flat configuration when nothing is retained therein. This combination of elements ensures an easily stored container that takes up much less space than the metal containers. The inclusion of the captured rigid members forming part of the walls of the container 10 ensure that when in use, the container 10 is sufficiently rigid to stand up to the rigors of expected operation of this type of container.

Such containers are also substantially less expensive than the conventional metal containers.

While the collapsible container described in U.S. Pat. No. 6,000,604 is a great improvement over the storage/transport containers of the prior art, there are two ways in which the container described in that patent can be improved. First, the retaining bag 32 is suggested as a suitable means for retaining wet materials. It is indicated that the bag may be fabricated of a variety of any of the non-metallic materials woven polypropylene, waterproofed woven polypropylene, polyethylene, high-density polyethylene, nylon, or combinations thereof. Unfortunately, those materials specifically suggested fail to enable use of the container 10 for the purpose of holding relatively hot materials including, but not limited to, spent catalysts.

In the field of chemical processing, a fairly standard technique for accelerating and/or facilitating chemical reactions includes the introduction of catalysts and perhaps the application of heat. The catalysts provide sites for reactions to occur. However, they generally have limited useful lives and must therefore be replaced to ensure optimal efficiency in the chemical reaction process. The process of removing the catalyst generally involves a dumping from a reactor into a container. That container must be fabricated of a material sufficient to withstand the temperatures ordinarily used in such reactions. Those temperatures can be as much as 750° F. The materials suggested for the bag 32 as well as the walls 12, 14, 16, and 18 of container 10 could only reasonably be expected to safely retain materials at temperatures of about 200° F. Given the quantity of catalyst to be removed, it can take several weeks for cool-down to a temperature suitable for introduction into container 10. As a result, the container user would be required to store the spent catalyst for that period of time before then placing it in the container. That is not a desirable situation. Instead, it would be preferable to have a collapsible container capable of retaining materials including, but not limited to catalysts, at elevated temperatures. Such a container would save its user considerable cost by allowing that user to employ the container when convenient, rather than waiting for weeks for material cool down. Given the considerable rental fees associated with metal containers, a less-expensive collapsible container could be employed when desired.

Relatedly, it is important that when catalyst in particular is to be retained in the container, the possibility of further chemical reactions occurring be substantially minimized. Although catalysts are typically removed from reactors when the reaction efficiency declines, there nevertheless remains some reactivity. Such reactivity can be enhanced under a variety of atmospheric conditions. One of those conditions is the availability of reactive gases such as oxygen. The availability of oxygen to the catalyst can cause continuing reactions that can produce hazardous offgassing as well as increased temperatures within the container. Increased temperatures can cause an acceleration of the reaction, causing a greater increase in temperature, and so on. For that reason, it is important that the container used to retain reaction catalysts in particular be substantially impervious to reactive gases such as oxygen. U.S. Pat. No. 6,000,604 fails to disclose such a requirement as part of the design of the container 10.

A second limitation of the collapsible container 10 of the prior art is the cover design. Although cover 22 provides an effective seal to prevent the bulk material within from escaping the container 10, it may be inadequate to block weather conditions from entering from the outside. In particular, bulk material containers are often left in open storage locations. They therefore experience precipitation such as rain, sleet, snow, and the like. The design of container 10 as shown particularly in FIG. 6 of U.S. Pat. No. 6,000,604 renders the container 10 susceptible to water seepage into the container, particularly at the upper corners of the container 10. Such seepage may potentially cause damage to the rigid member forming the structural member of the walls of the container. Moreover, the water seepage may potentially have an adverse effect on the bulk material stored therein, dependent upon the characteristics of that material.

Therefore, what is needed is a collapsible container for the storage and transport of bulk materials suitable for retaining materials at elevated temperatures. What is also needed is a collapsible container that minimizes the introduction of reactive components to the contents of the container. Further, what is needed is a storage container including an effective cover to minimize the introduction of fluids from the exterior to the interior of the container.

SUMMARY OF THE INVENTION

It is an object of the present invention to provide a collapsible container for the storage and transport of bulk materials suitable for retaining materials at elevated temperatures. It is also an object of the present invention to provide a collapsible container that minimizes the introduction of reactive components to the contents of the container. Further, it is an object of the present invention to provide a storage container including an effective cover to minimize the introduction of fluids from the exterior to the interior of the container.

These and other objects of the present invention are achieved by introducing a protective liner to a storage container, such as a collapsible, semi-rigid storage container. The protective liner is designed to be retained within the interior of the container and, for collapsible containers, with minimal impact on the collapsing method. The liner is made of a material that is a barrier to reactive gases, such as oxygen. It is also resistant to deformation or failure under relatively high temperatures when compared the temperature resistance of the prior optional bag described in the referenced prior patent. Additionally, the material of the liner of the present invention is relatively flame-resistant. One example of a material suitable for this purpose is a co-extrusion of polypropylene/nylon/polypropylene "hot fill." This blend offers high-temperature resistance, water repellant, and a strong oxygen barrier, particularly when compared to other polymeric blends. It is to be noted, however, that other materials may be suitable for this application provided they exhibit similar isolation characteristics.

The introduction of the protective liner of the present invention provides the means for storing and transporting spent catalysts. In particular, using a process in which a coolant means, such as dry ice or other suitable cooling medium, and the liner are placed within the container, such as the collapsible container of U.S. Pat. No. 6,000,604, relatively hot catalyst may be retained. First, the protective liner is placed into the semi-rigid container and the coolant means is placed into the liner. It is to be noted that the coolant means may have its own separate retainer, such as a liner, to isolate it from the bulk material to be shipped. The spent catalyst is then placed within the container in direct or substantially direct contact with the coolant means. It is to be noted that the catalyst may be at an elevated temperature defined by the limitations of the liner's characteristics, including, but not limited to, a temperature of about 200° F. The liner may then be closed and a layer of coolant placed on the top of the closed liner. The container is then closed and the container moved to a desired location. The introduction of the coolant aids to accelerate cooling of the spent catalyst while the liner ensures that oxygen is prevented from contacting the catalyst once the container is closed. The characteristics of the liner substantially minimize that contact. Prior to closing the container, a nitrogen probe line may be inserted into the container to introduce a nitrogen coolant to aid further in the accelerated cooling of the contained catalyst.

The addition of the impervious liner to a storage container permits retention of bulk materials that previously could not be easily retained at relatively high temperatures in semi-rigid containers. Moreover, the introduction of such a liner to a collapsible semi-rigid container expands the capability of such a container. As previously noted, collapsible containers have particular advantages over existing metal containers and simple plastic bags. Those advantages are enhanced when that type of container includes the liner of the present invention to enable retention of high-temperature reactive materials.

A separate improvement of the container of the present invention is the application of a dedicated weather-blocking cover. The cover of the present invention supplements the function of the existing lid disclosed in U.S. Pat. No. 6,000,604. In particular, it is a flexible unitary structure that may be fabricated of the same material used to form the interior and exterior layers of the sandwich walls of the collapsible container. The cover structure may be formed integrally with the cover flap 22 of the container 10 of FIG. 1. Alternatively, it may be a separate component including a plurality of grommets or burn holes through which flexible tie-downs may be used to secure it to the walls of the container. Preferably, the weather-blocking cover of the present invention is formed of sufficient dimensions to ensure that it passes over all upper corners of the container so that it may be retained in place on the walls. That arrangement eliminates a direct interface between the upper corners of the container and the surrounding environment. Addition of the supplemental blocking cover permits outdoor storage of a filled container or a plurality of stacked containers, for an extended period.

The introduction of either one or both of the impervious liner and the blocking cover improve the storage capability of any container, but particularly a collapsible container of the type described in U.S. Pat. No. 6,000,604. Such a container may be used to provide a cost-effective means for owning a plurality of containers that can hold and transport bulk materials including spent catalyst. It is capable of retaining materials including, but not limited to, self-heating, solid, inorganic sulfides, sulfurs, and the like that may be classified as class 4.2 under the International Maritime Dangerous Goods code. Further, a single container can be used to replace a plurality of 55-gallon drums. While made of materials that make it lightweight when empty, the lined collapsible container may readily retain up to 3000 lbs. of bulk material.

These and other advantages of the present invention will become more apparent upon review of the following detailed description and the accompanying drawings.

DETAILED DESCRIPTION OF THE PREFERRED EMBODIMENT OF THE INVENTION

Figure 2:
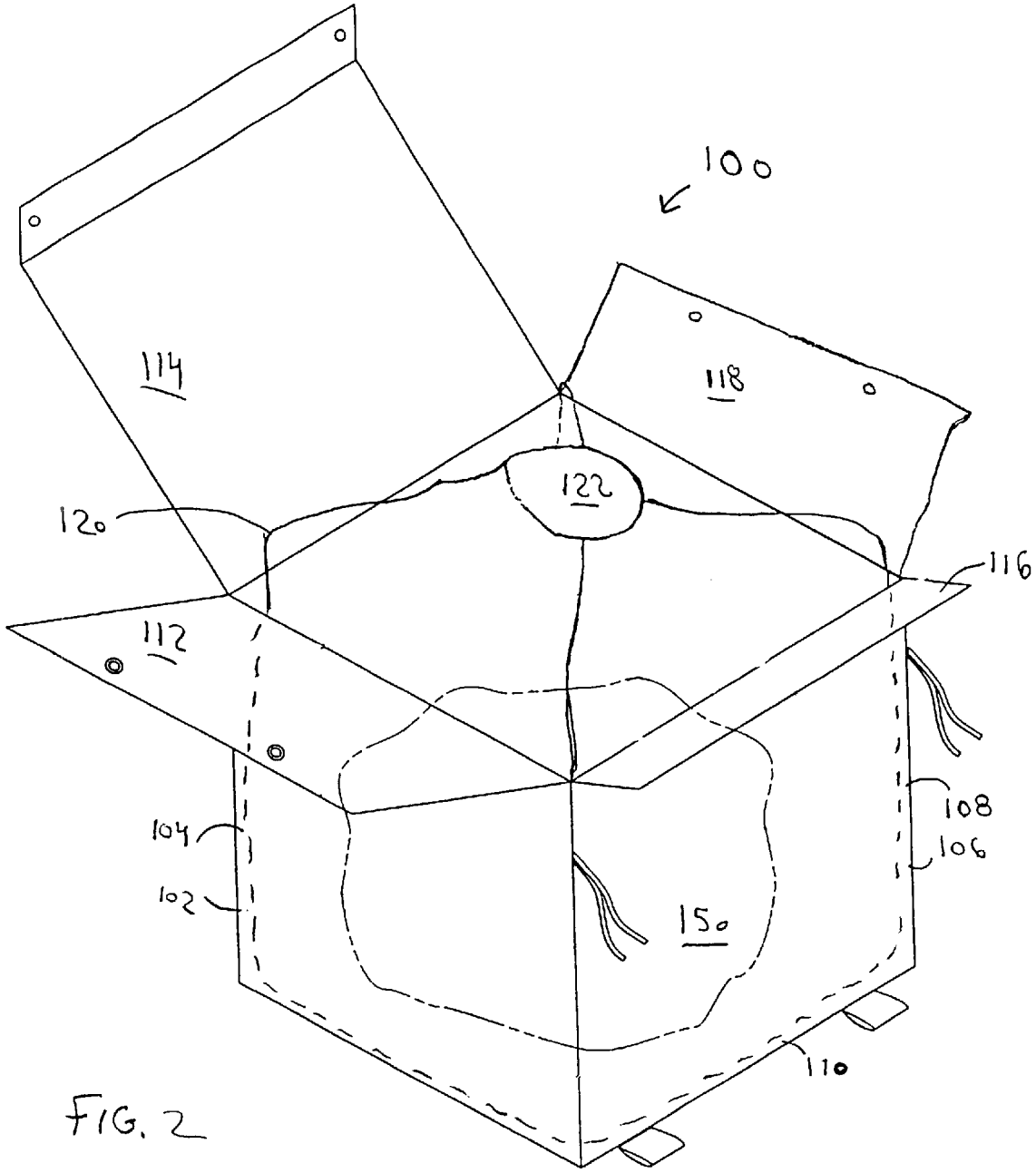
FIG. 2 is a perspective view of a container of the present invention showing the impervious liner used to retain, among other things, spent catalyst.

A storage container 100 of the present invention is shown in FIG. 2. The storage container 100 includes a plurality of wall sections 102, 104, 106, and 108 substantially the same as the wall assemblies described in U.S. Pat. No. 6,000,604. The wall sections 102–108 may be fixed or collapsible and preferably include at least an inner layer and an outer layer enclosing a substantially rigid reinforcing body therebetween. The inner and outer layers may be formed if a tough flexible material 5 including, but not limited to, woven polypropylene. The wall sections 102–108 in combination with a bottom section 110 define an interior cavity within which bulk material may be placed for storage and/or transport. Each of wall sections 102–108 includes its own cover flap. Specifically, wall section 102 is formed with integral cover flap 112, wall section 104 is formed with integral cover flap 114, wall section 106 is 10 formed with integral cover flap 116 and wall section 108 is formed with integral cover flap 118. Each of the cover flaps 112–118 may be formed by joining together the inner and outer layers used to form, in part, the wall sections 102–108. Additionally, one or more of the cover flaps may have incorporated between the inner and outer layers structural reinforcement, such as the stiffening panel taught in the referenced prior art. When moved from an open position as shown in FIG. 2 to a closed position, the cover flaps 112–118 act to enclose bulk material 150 within the cavity.

With continuing reference to FIG. 2, an impervious liner 120 of the present invention is adapted to be established within the cavity of the container 100. The liner 120 is designed to retain a volume of material at least as great as the volume of the cavity of the container 100 and preferably to extend beyond the upper dimensions of the wall sections 102–108. The liner 120 includes an opening 122 for receiving the bulk material 150 therein. The liner 120 is particularly adapted to receive reactive materials that may be at temperatures in excess of room temperature, including temperatures in excess of 200° F. Bulk materials for which the liner 120 is adapted to receive include, but are not limited to, spent catalysts used to facilitate chemical reactions. In order to minimize contact of the bulk material 150 with external conditions that may trigger undesired activity within the liner 120, the liner 120 is preferably formed of a flame-resistant material that is substantially impervious to absorption or pass-through of reactive fluids such as oxygen. At the same time, the liner 120 must be formed of a sufficiently flexible material to allow for ordinary operation of the container 100. In order to achieve these potentially conflicting goals, the liner 120 is preferably fabricated of a non-metallic material such as a polypropylene/nylon/polypropylene blend.

Figure 2A:
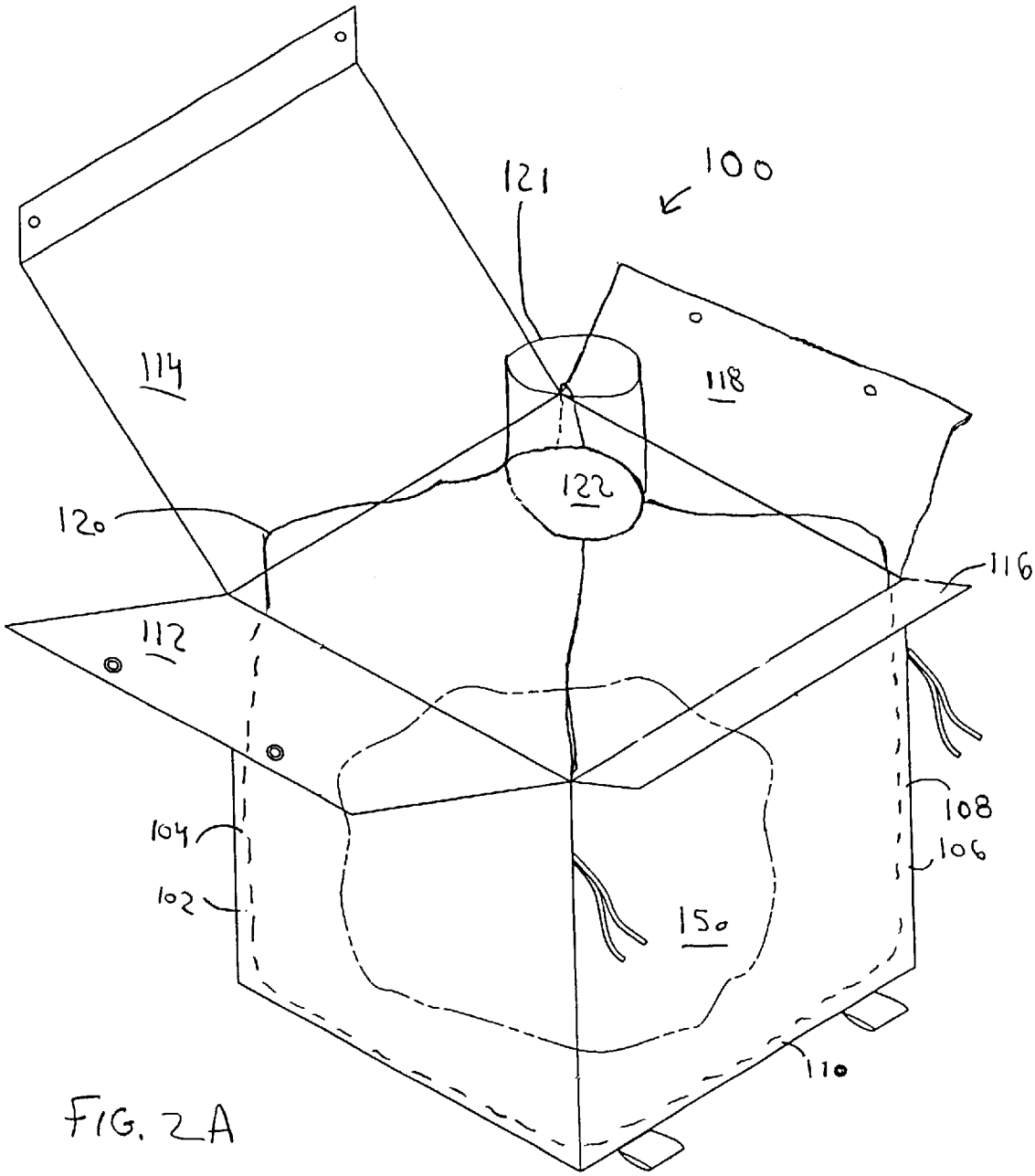
FIG. 2A is a perspective view of a container of the present invention showing the impervious liner and an optional fill spout for funneling bulk material into the container.

In an alternative embodiment of the invention shown in FIG. 2A, the liner 120 may include an optional fill spout 121 as a means to funnel bulk material more easily into the liner 120. Of course, for some bulk materials, the fill spout may not be suitable and therefore omitted from the design of the container 100. The fill spout 121 may be formed as an integral part of the liner 120 or may be removably attached to the opening 122 of the liner 120. The fill spout 121 may be formed as a flexible element that is maneuvered into position for the filling process or it may alternatively include a relatively rigid structural component within layers thereof to maintain it in a fixed position during the filling process.

Figure 3:
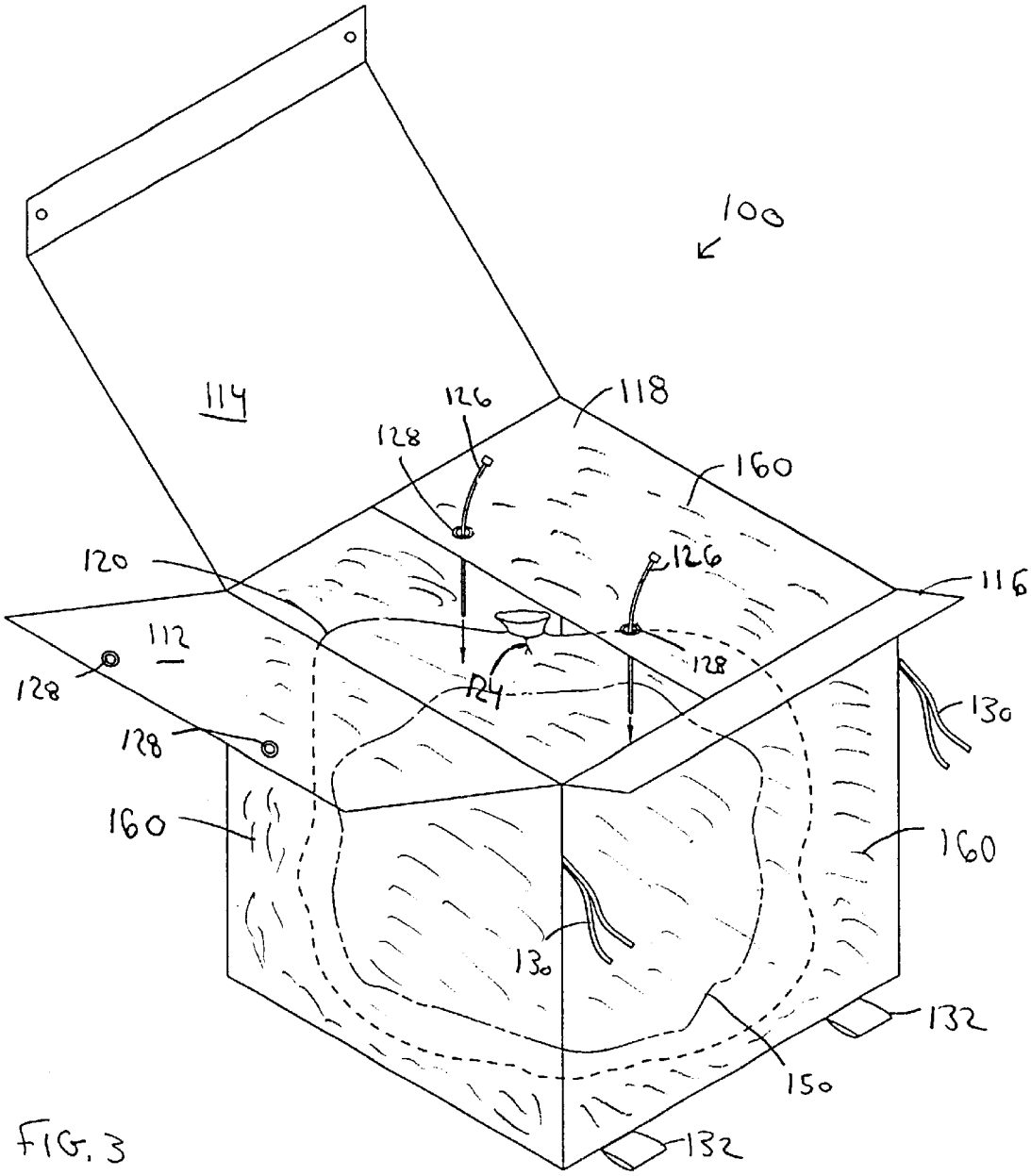
FIG. 3 is a perspective view of the container of the present invention including the liner and a charge of coolant around the liner to cool the bulk material retained therein.

A method of using the liner 120 as part of the container 100 to enclose a relatively hazardous bulk material such as a hot spent catalyst will be described with reference to FIGS. 2 and 3. The method includes the step of opening all of the cover flaps 112–118 of the container 100 and fixing the positions of the wall sections 102–108 with respect to one another so as to establish a relatively rigid, lightweight, free-standing storage/transport container. The open container is then directed to a location where bulk material is ready for transfer. The liner 120 is inserted into the cavity of the open container 100 positioned such that the coolant 160 may be retained within the container 100. Next, a coolant means, such as a cooling water jacket or dry ice 160 is placed into the liner 120. A coolant means separation liner may be employed to keep the coolant away from direct contact with the bulk material 150 to be cooled and/or contained. The bulk material 150 is next directed through the opening 122 and into the interior of the liner 120. The opening 122 of the liner 120 is then closed, preferably using a flexible tie element 124, or is alternatively heat sealed, in a manner that substantially minimizes the possibility of fluids entering the liner 120. Before closing the liner 120, however, additional coolant 160 may be inserted into the top region of the liner 120 so as to substantially encase the bulk material 150 in the coolant 160. The cover flaps 118 and 112 are moved to closing positions and connected together using flexible cover closures 126 that pass through eyelets 128 of those two cover flaps. Cover flap 116 is then closed and finally flap 114 is placed in a closing position and tied off with flexible sealing closures 130 that may be formed integrally into the corners of wall sections 102 and 106–108. Securing straps 132 may be used to secure the filled container 100 to a rigid structure, such as a pallet, for ease of movement.

For certain bulk containment processes, a nitrogen probe in the form of a tube containing liquid nitrogen may be placed within the liner 120 prior to adding the bulk material 150. Directing liquid nitrogen through the tube further aids in cooling the bulk material 150 that may have exothermic characteristics. Temperature measurements taken during and after the filling process provide information to define the amount of liquid nitrogen to pass within the container 100 as a supplemental coolant means. When the user of the system is satisfied that the bulk material 150 is at a desired temperature, the nitrogen probe line may be removed from within the container 100 and the liner 120 closed.

Figure 1:
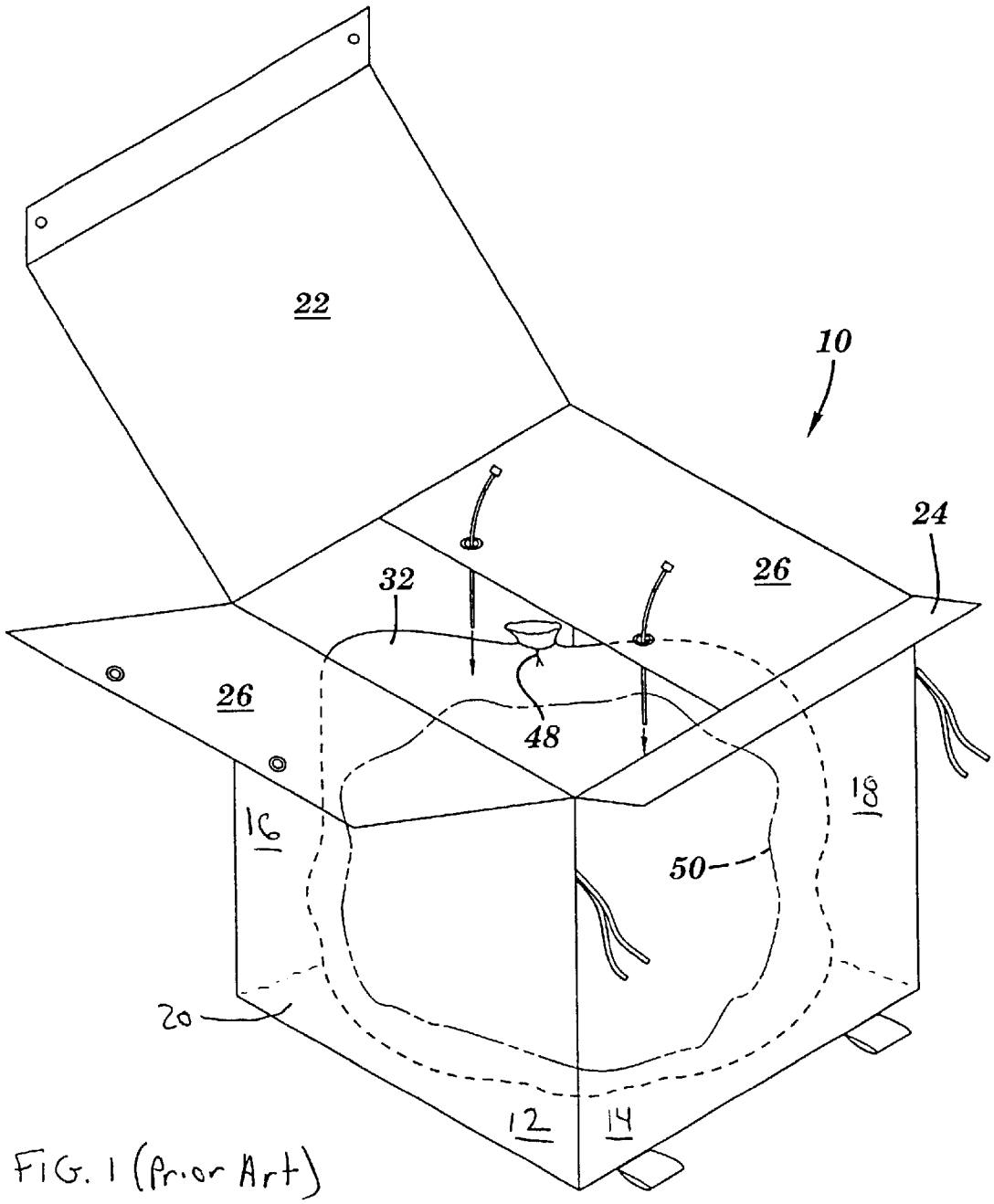
FIG. 1 (Prior Art)
FIG. 1 is a perspective view of a collapsible container of the prior art, showing the optional bag used to retain wet materials.
Figure 4:
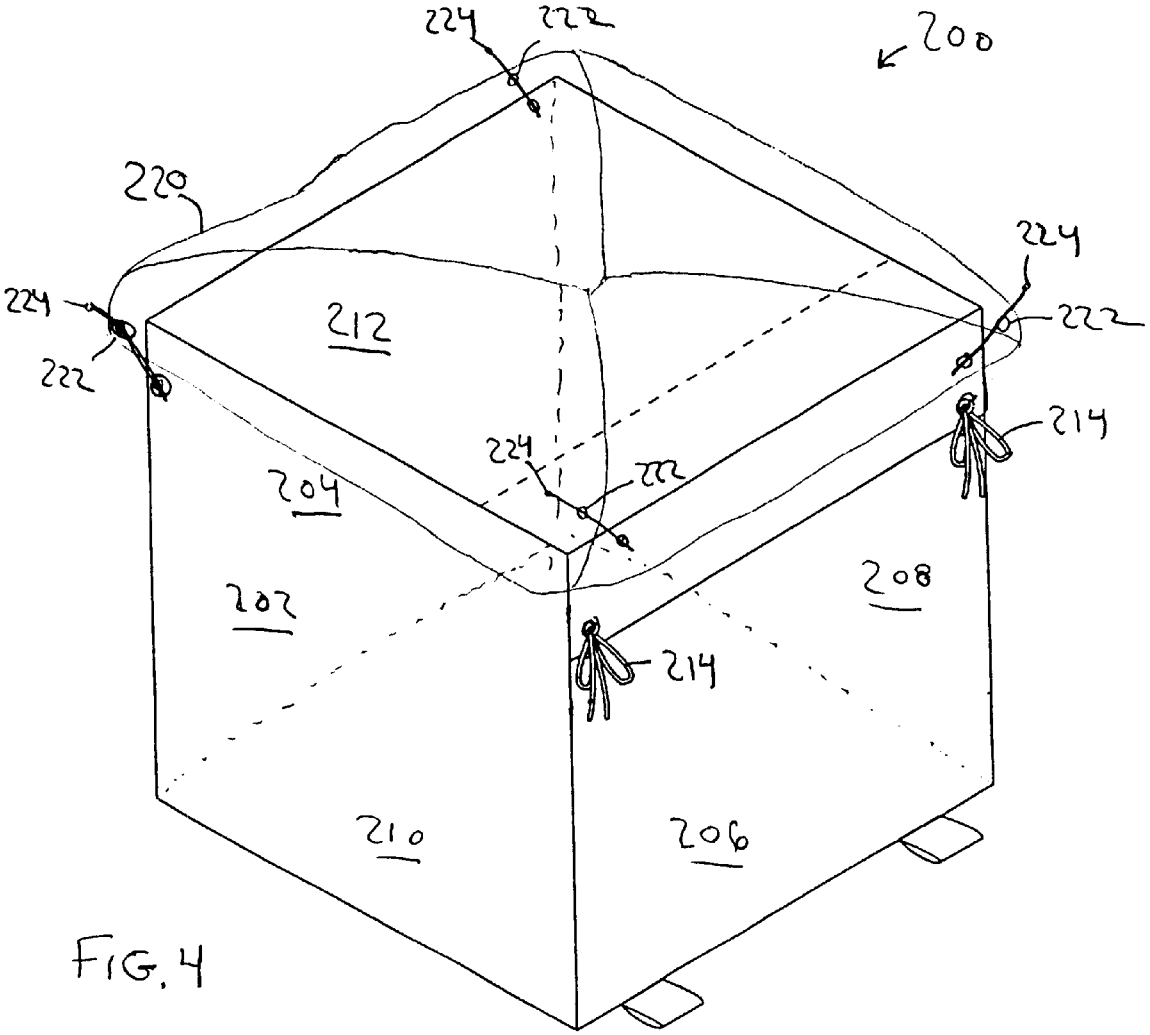
FIG. 4 is a perspective view of a container of the present invention showing the weather-blocking cover.

An alternative container 200 of the present invention is shown in FIG. 4. The container 200 may be any sort of fixed or collapsible container, including the collapsible container of U.S. Pat. No. 6,000,604. The container 200 includes a plurality of wall sections 202, 204, 206, and 208 and a bottom section 210 that together establish a cavity within which bulk material may be retained. The container 200 may also, and preferably does, include a primary cover system 212 that may be formed of a single section connected to wall section 206 using cover ties 214. Alternatively, the cover system 212 may include a plurality of cover flap sections such as those shown in FIGS. 1–3. With or without the primary cover system 212, the container 200 of the present invention includes a weather-protective cover 220. The cover 220 is preferably formed as a unitary structure of a tough, flexible, weather-impermeable material such as woven polypropylene, waterproofed woven polypropylene, polyethylene, high-density polyethylene, nylon, or suitable combinations thereof. The cover 220 may be fabricated of the same material used to create the inner and outer layers of the wall sections 102–108 shown in FIG. 2. The cover 220 includes eyelets 222 for receiving cover tie-downs 224 such as the flexible ties 126 used to secure the covers shown in FIG. 3, and couple the cover 220 to the respective walls of the container 200. The cover is sized to ensure that it drapes over all upper surfaces of the container 200 and preferably extends beyond the perimeter of the cover 200 so as to completely cover all corners thereof. In this way, any precipitation from a weather event will not leak into the cavity of the container 200. Therefore, the container 200 may be employed to store bulk materials at unprotected storage sites.

The design of the container 100/200 of the present invention additionally provides the benefit of enabling easy visual inspection of the contents of the container. Further, the unitary cover structure allows for stacking of multiple containers with greater ease due to the solid, linear nature of the cover. Moreover, the flaps that extend over the sidewalls help minimize sidewall distortion when a load is placed on top of the container.

Although the present invention has been described and illustrated with specific reference to certain detailed designs, it will be apparent to those skilled in this field that alternative embodiments will achieve the same results without deviating from the basic concept of the invention. All such embodiments and their equivalents are deemed to be within the scope of the invention as set out in the description.

What is claimed is:

1. A container adapted to retain bulk material therein, the container comprising:

a. a plurality of wall sections each including a stiffening structure captured between layers of flexible protective material, wherein said wall sections are adapted to be collapsible upon one another;

b. a flexible bottom section coupled to said plurality of wall sections, wherein said wall sections and said bottom section in combination establish a cavity for retaining the bulk material therein;

c. a cover section formed integrally with at least one of said wall sections, said cover section adapted to selectively open and close so as to enclose the bulk material within said cavity; and d. an impervious liner within said cavity, wherein said liner is adapted to withstand temperatures of the bulk material in excess of 200° F., wherein said impervious liner is fabricated of a polypropylene/nylon/polypropylene blend.

2. The container as claimed in claim 1 wherein said wall sections, said bottom section, and said cover section are adapted to be connected together to be alternately collapsed for storage and erected to a self-supporting configuration.

3. The container as claimed in claim 1 further comprising a weather-blocking cover adapted to be coupled to one or more of said wall sections, wherein said weather-blocking cover is adapted to extend beyond all dimensions of said cover section.

4. The container as claimed in claim 3 wherein said weather-blocking cover is fabricated of one or more materials selected from the group consisting of woven polypropylene, waterproofed woven polypropylene, polyethylene, high-density polyethylene, and nylon.

5. A container adapted to retain bulk material therein, the container comprising:

a. a plurality of wall sections each including a stiffening structure captured between layers of flexible protective material, wherein said wall sections are adapted to be collapsible upon one another;

b. a flexible bottom section coupled to said plurality of wall sections, wherein said wall sections and said bottom section in combination establish a cavity for retaining the bulk material therein;

c. a primary cover section formed integrally with at least one of said wall sections, said cover section adapted to selectively open and close so as to enclose the bulk material within said cavity; and d. a weather-blocking cover adapted to be coupled to one or more of said wall sections, wherein said weather-blocking cover is adapted to extend beyond all dimensions of said primary cover section.

6. The container as claimed in claim 5 wherein said wall sections, said bottom section, and said cover section are adapted to be connected together to be alternately collapsed for storage and erected to a self-supporting configuration.

7. The container as claimed in claim 5 wherein said weather blocking cover is fabricated from one or more materials selected from the group consisting of woven polypropylene, waterproofed woven polypropylene, polyethylene, high-density polyethylene, and nylon.

8. The container as claimed in claim 5 further comprising an impervious liner within said cavity, wherein said liner is adapted to withstand temperatures of the bulk material in excess of 200° F.

9. The container as claimed in claim 8 wherein said impervious liner is fabricated of a polypropylene/nylon/polypropylene blend.

10. A container adapted to retain bulk material therein, the container comprising:

a. a plurality of wall sections each including a stiffening structure captured between layers of flexible protective material, wherein said wall sections are adapted to be collapsible upon one another;

b. a flexible bottom section coupled to said plurality of wall sections, wherein said wall sections and said bottom section in combination establish a cavity for retaining the bulk material therein;

c. a primary cover section formed integrally with at least one of said wall sections, said cover section adapted to selectively open and close so as to enclose the bulk material within said cavity;

d. a weather-blocking cover adapted to be coupled to one or more of said wall sections, wherein said weather-blocking cover is adapted to extend beyond all dimensions of said primary cover section; and e. an impervious liner within said cavity, wherein said liner is adapted to withstand temperatures of the bulk material in excess of 200° F.

11. The container as claimed in claim 10 wherein said wall sections, said bottom section, and said cover section are adapted to be connected together to be alternately collapsed for storage and erected to a self-supporting configuration.

12. The container as claimed in claim 11 wherein said weather-blocking cover is fabricated from one or more materials selected from the group consisting of woven polypropylene, waterproofed woven polypropylene, polyethylene, high-density polyethylene, and nylon.

13. The container as claimed in claim 12 wherein said impervious liner is fabricated of a polypropylene/nylon/polypropylene blend.

14. A collapsible container adapted to receive bulk material therein, the collapsible container comprising:

a. a plurality of wall portions, each of said plurality of wall portions including a plurality of layers of flexible sheet material and a semi-rigid stiffener superposed therebetween;

b. a bottom portion including at least one layer of flexible sheet material disposed integrally with said plurality of wall portions, wherein said bottom portion and said plurality of wall portions define a material receiving cavity;

c. a flexible closure assembly disposed integrally with at least one of said plurality of wall portions, said flexible closure assembly adapted to selectively open and close the material receiving cavity, said flexible closure assembly including:

i. a flexible cover extending integrally from one of said wall portions;

ii. a pair of side flaps extending from opposite wall portions and sized and shaped to extend towards one another for tensioned mutual engagement to substantially close the material receiving cavity when bulk material is disposed therein; and iii. cover securing means disposed integrally on one or more of said plurality of wall portions, said flexible cover sized and shaped for being secured in tension by said cover securing means in superposed orientation with said mutually engaged pair of side flaps to secure the bulk material within said collapsible container; and d. an impervious liner within said cavity, wherein said liner is adapted to withstand temperatures of the bulk material in excess of 200° F., said impervious liner being fabricated of a polypropylene/nylon/polypropylene blend, wherein said collapsible container is a unitary device adapted for being alternately collapsed for storage and erected to a self-supporting configuration for receipt and containment of the bulk material.

15. The container as claimed in claim 14 further comprising a weather-blocking cover adapted to be coupled to one or more of said plurality of wall portions, wherein said weather-blocking cover is adapted to extend beyond all dimensions of said flexible cover.

16. The container as claimed in claim 15 wherein said weather-blocking cover is fabricated of one or more materials selected from the group consisting of woven polypropylene, waterproofed woven polypropylene, polyethylene, high-density polyethylene, and nylon.

* * * * *